US005315354A

United States Patent [19]

Mordenga

[11] Patent Number: 5,315,354

[45] Date of Patent: May 24, 1994

[54] CARRIER BEAD SEAL

[75] Inventor: Samuel P. Mordenga, Rochester, N.Y.

[73] Assignee: Xerox Corporation, Stamford, Conn.

[21] Appl. No.: 51,718

[22] Filed: Apr. 23, 1993

[51] Int. Cl.[5] ..... G03G 15/06

[52] U.S. Cl. ..... 355/260; 355/215; 355/245; 355/257; 355/261

[58] Field of Search ..... 355/259, 260, 215, 245, 355/261-262, 265; 118/653, 647-648, 661

[56] References Cited

U.S. PATENT DOCUMENTS

| | | | |
|---|---|---|---|
| 3,788,275 | 1/1974 | Hanson | 118/658 |
| 3,906,899 | 9/1975 | Harpavat | 118/655 |
| 4,571,060 | 2/1986 | Bares | 355/245 X |
| 5,253,016 | 10/1993 | Behe et al. | 355/261 X |

OTHER PUBLICATIONS

Xerox Disclosure Journal, vol. 5, No. 1, p. 15; Title: Magnetic Bearing Seal; Published; Jan./Feb. 1980.

Xerox Disclosure Journal vol. 14, No. 5, p. 312; Title: Donor Roll Seal; Published: Sep./Oct. 1989.

*Primary Examiner*—Matthew S. Smith

*Attorney, Agent, or Firm*—H. Fleischer; J. E. Beck; R. Zibelli

[57] ABSTRACT

An apparatus in which an electrostatic latent image recorded on a photoconductive member is developed with toner. A donor roll, spaced from the photoconductive member, transports toner to a development zone adjacent the photoconductive member. An electrode member is positioned in the development zone between the photoconductive member and the donor roll. A magnetic roll transports carrier granules and toner particles to a loading zone adjacent the donor roll. In the loading zone, toner particles are attracted from the magnetic roll to the donor roll. A sealing member has a magnetic field induced therein by the magnet in the magnetic roll. The sealing member attracts carrier granules thereto preventing the carrier granules for being transported to the donor roll.

16 Claims, 3 Drawing Sheets

CARRIER BEAD SEAL

This invention relates generally to the development of electrostatic latent images, and more particularly concerns a scavengeless development unit in which carrier bead carryout is controlled.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two-component and single-component developer materials are commonly used. A typical two-component developer material comprises magnetic granules i.e. carrier granules, having toner particles adhering triboelectrically thereto. A single-component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single-component development systems use a donor roll for transporting charged toner to the development nip defined by the donor roll and the photoconductive surface. The toner is developed on the latent image recorded on the photoconductive surface by a combination of mechanical and/or electrical forces. Scavengeless development and jumping development are two types of single-component development systems. A scavengeless development system uses a donor roll with a plurality of electrode wires closely spaced therefrom in the development zone. The electrode wires are electrically biased relative to the donor roll so as to detach toner therefrom forming a toner powder cloud in the development zone. The electrostatic field generated by the latent image attracts toner from the toner powder cloud to develop the latent image. In jumping development, an electrical bias is applied to the donor roll, detaching toner from the donor roll and projecting the toner toward the photoconductive member so that the electrostatic field generated by the latent image attracts the toner to develop the latent image. Single-component development systems appear to offer advantages of low cost and design simplicity. Two-component development systems have been used extensively in many different types of printing machines. A two-component development system usually employs a magnetic brush developer roller for transporting carrier having toner adhering triboelectrically thereto. Electrostatic fields generated by the latent image attract the toner from the carrier so as to develop the latent image. In high speed commercial printing machines, a two-component development system may have lower operating costs than a single-component development system. Clearly, two-component development systems and single-development systems each have their own advantages. It has been found that it is desirable to combine these systems to form a hybrid-type of development system incorporating the desirable features of each system. Such a hybrid-type of development system uses a donor roll and a magnetic roller. The donor roll and magnetic roller are electrically biased relative to one another. The magnetic roll transports two-component developer material to a loading zone defined by the donor roll and magnetic roll. Toner is attracted to the donor roll from the magnetic roll. The donor roll is rotated synchronously with the photoconductive drum. Electrode wires, located in the development zone, are electrically biased to detach the toner from the donor roll. The detached toner forms a toner powder cloud in the development zone which develops the latent image on the photoconductive surface. This type of development system is a hybrid scavengeless development system. In a hybrid scavengeless development unit of this type, it is necessary to prevent carrier beads from being transported to the donor roll. Carrier beads advanced on the donor roll can cause scratching or other photoreceptor damage. This results in a quality defect in the developed image.

The following disclosures may be relevant to various aspects of the present invention:

U.S. Pat. No. 3,788,275
Patentee: Hanson
Issued: Jan. 29, 1974
U.S. Pat. No. 3,906,899
Patentee: Harpavat
Issued: Sep. 23, 1975
U.S. Pat. No. 4,571,060
Patentee: Bares
Issued: Feb. 18, 1986
Xerox Disclosure Journal
Vol. 5, No. 1, p. 15
Title: Magnetic Bearing Seal
Published: January//February 1980
Xerox Disclosure Journal
Vol. 14, No. 5, p. 231
Title: Donor Roll Seal
Published: September/October 1989

The relevant portions of the foregoing disclosures may be briefly summarized as follows:

U.S. Pat. No. 3,906,899 describes a magnetic seal for a developer housing. The magnet flux attracts magnetic particles to form a seal between the developer housing and the photoconductive drum.

U.S. Pat. No. 3,788, 275 describes a ring magnet adapted to attract magnetic carry a granules thereto so as to form a shield of carrier granules between the bearings and hub. As the hub rotates, the exterior threaded portion thereof impels carrier granules away from the bearings.

U.S. Pat. No. 4,571,060 describes a seal which attracts toner particles. The captured toner particles that are softened to become tacky. Additional donor particles stick to the tacky toner particles preventing their escape. Each successive layer of toner particles is softened and becomes tacky capturing other toner particles.

Xerox Disclosure Journal, Vol. 14, No. 5, describes a foam seal used to seal opposed ends of a donor roll. The foam seal interfaces, with foam end blocks to seal the ends of the donor roll and prevent the escape of toner particles from the developer housing.

Xerox Disclosure Journal, Vol. 5, No. 1 describes a rubber, magnetic diaphragm inserted in opposed ends of a tubular member to attract magnetic carrier thereto. The magnetic carrier granules cooperate with the diaphragm to act as a seal preventing contamination of bearings so as to extend the life thereof.

In accordance with one aspect of the present invention, there is provided an apparatus for developing a latent image recorded on a surface with toner. The apparatus includes a magnetic member adapted to transport magnetic carrier and toner to a loading zone. A donor member is positioned adjacent the magnetic member to receive toner therefrom at the loading zone. The donor member is spaced from the surface and advances toner to a development zone adjacent the surface. A sealing member is partially interposed between the magnetic member and the donor member. The sealing member prevents carrier from being transported from said magnetic member to said donor member at the loading zone.

Pursuant to another aspect of the present invention, there is provided an electrophotographic printing machine of the type in which an electrostatic latent image recorded on a photoconductive member is developed with toner to form a visible image thereof. The improvement in the printing machine includes a magnetic member adapted to transport magnetic carrier and toner to a loading zone. A donor member is positioned adjacent the magnetic member to receive the toner therefrom at the loading zone. The donor member is spaced from the surface and advances the toner to a development zone adjacent the surface. A sealing member is partially interposed between the magnetic member and the donor member. The sealing member prevents carrier from being transported from said magnetic member to said donor member at the loading zone.

Other features of the present invention will become apparent as the following description proceeds and upon reference to the drawings, in which.

While the present invention will be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
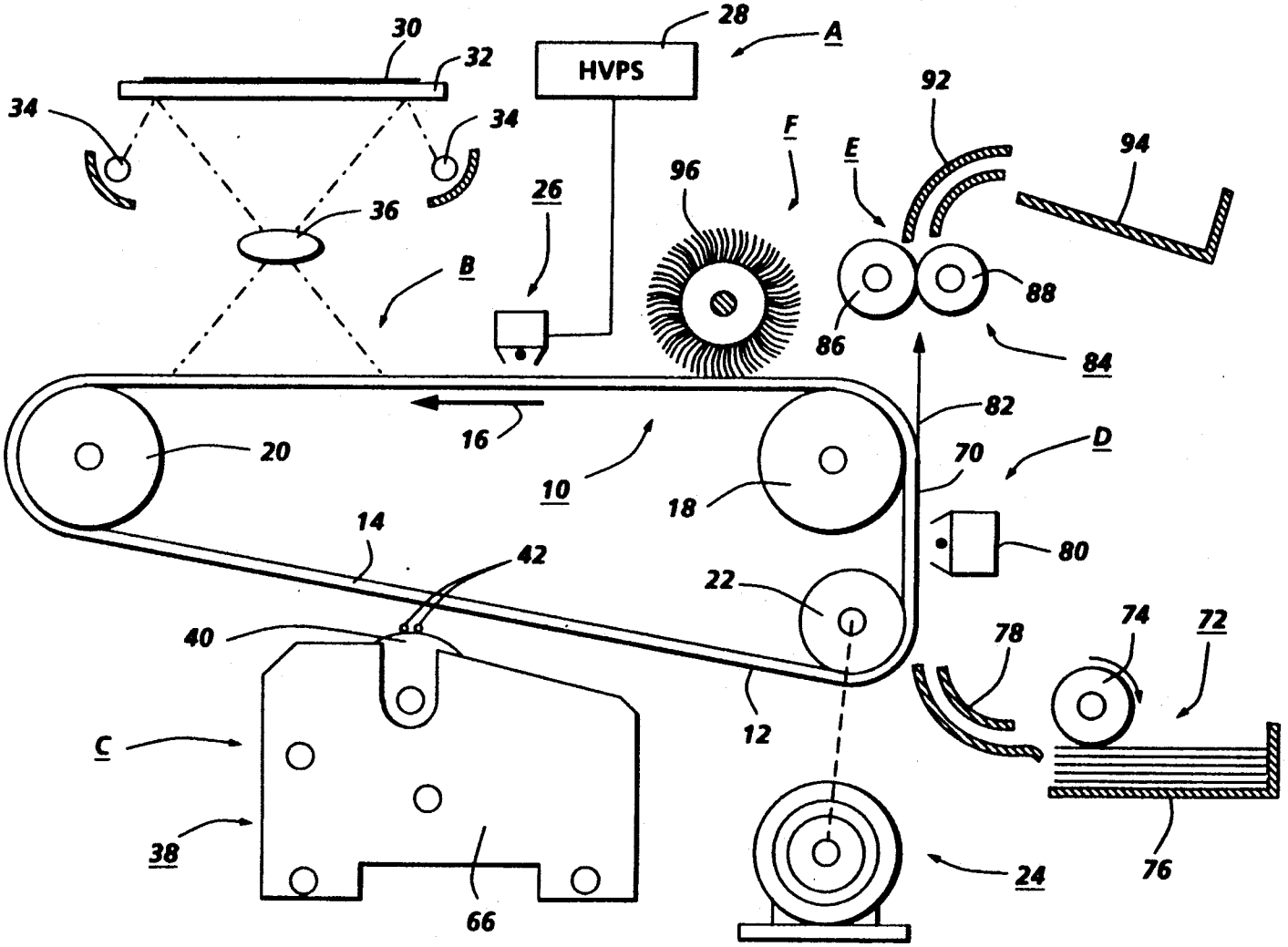
FIG. 3 is a schematic elevational view of an illustrative electrophotographic printing machine incorporating the development apparatus of the present invention therein.

Referring initially to FIG. 3, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface sequentially through the various processing stations disposed throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Belt 10 is maintained in tension by a pair of springs (not shown) resiliently urging tensioning roller 20 against belt 10 with the developed spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed facedown upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Developer unit 38 includes donor roll 40 and electrode wires 42. Electrode wires 42 are electrically roller 44 (FIG. 1 and FIG. 2) transports developer material to a loading zone adjacent donor roll 40. Donor roll 40 is electrically biased relative to magnetic roller 44 so as to attract toner particles thereto in the loading zone. The foregoing will be described in greater detail with reference to FIGS. 1 and 2.

With continued reference to FIG. 3, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76. Sheet feeding apparatus 72 advances sheet 70 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the backside of sheet 70. This attracts the toner powder image from photoconductive surface 12 to sheet 70. After transfer, sheet 70 continues to move in the direction of arrow 82 onto a conveyor (not shown) that advances sheet 72 to fusing station E.

Fusing station E includes a fuser assembly, indicated generally by the reference numeral 84, which permanently affixes the transferred powder image to sheet 70. Fuser assembly 84 includes a heated fuser roll 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 90 to catch tray 94 for subsequent removal from the printing machine by the operator.

After the sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
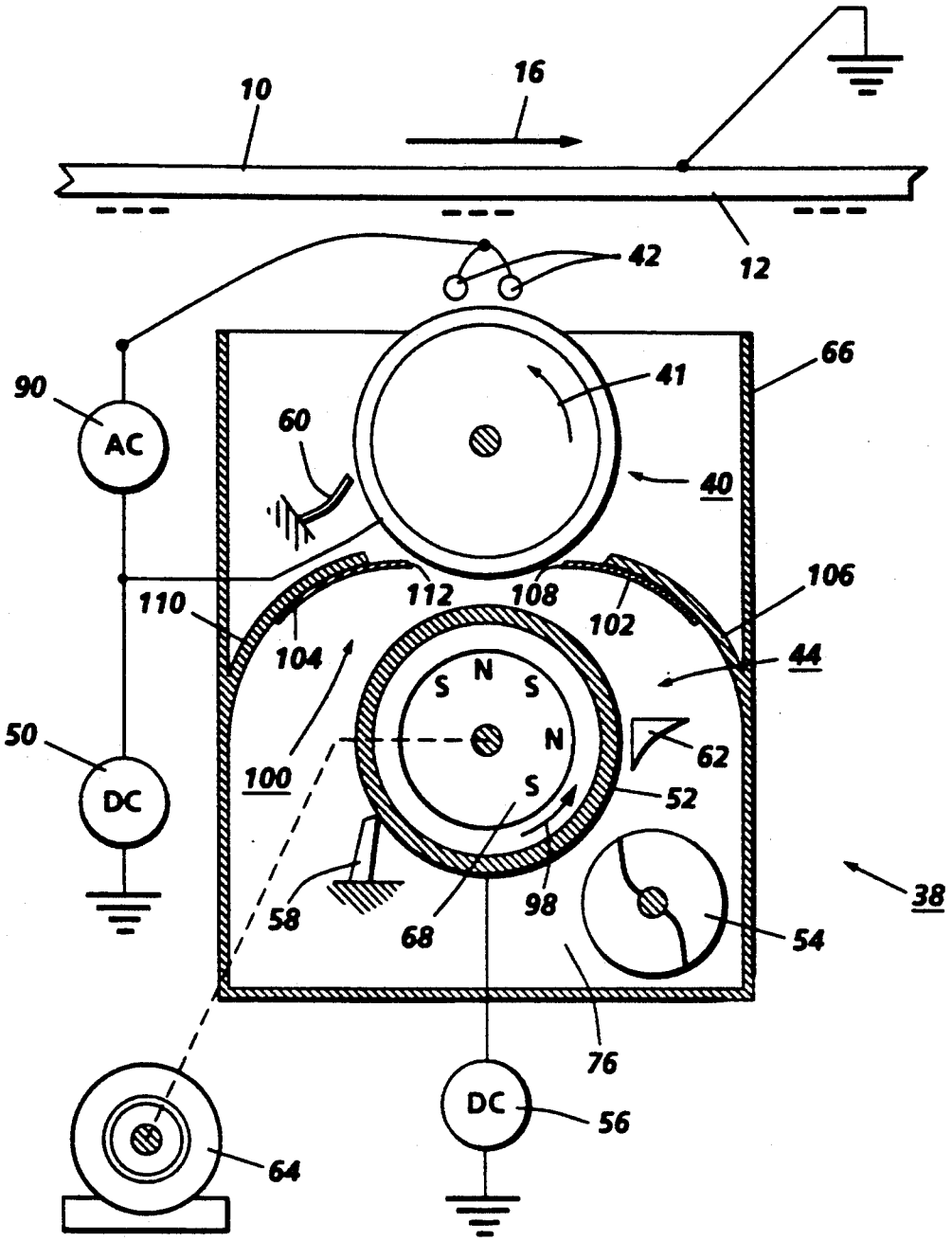
FIG. 1 is a schematic elevational view showing one embodiment of the development apparatus used in the FIG. 3 printing machine.

Referring now to FIG. 1, there is shown one embodiment of the present invention in greater detail. The development system 38 includes a donor roll 40, electrode wires 42, and magnetic roll 44. Donor roll 40 conveys developer material comprising toner deposited thereon by magnetic roll 44. The donor roll 40 can be rotated in either the (with) or (against) indicates relative to the direction of motion of belt 10. The donor roll is shown rotating in the direction of arrow 41. Electrode wires are located in the development zone, i.e. the space between the photoconductive surface 12 and donor roll 40. The electrode wires include one or more thin tungsten wires which are lightly positioned against donor roll 40. The distance between the wires and the donor roll is approximately the thickness of the toner layer on the donor roll. The extremities of the wire are supported by the tops of end bearing blocks (not shown) which also support the donor roll 40 for rotation.

An A.C. electrical bias is applied to the electrode wires by AC voltage source 90. In addition, a D.C. power supply 50 electrically biases electrode wires 42 and donor roll 40. Electrode wires 42 are located in the space between belt 10 and donor roll 40. This space defines the development zone.

D.C. power supply 50 establishes an electrostatic field between photoconductive surface 12 and donor roll 40 for attracting the detached toner particles from the cloud surrounding wires 42 to the latent image recorded on photoconductive surface 12. Magnetic roll 44 advances developer material comprising at least carrier granules and toner particles to a location adjacent donor roll 40, i.e. the loading zone. Magnetic roll 44 includes a non-magnetic tubular member or sleeve 52 made preferably from aluminum and having the exterior circumferential surface thereof roughened. An elongated multi-pole magnet 68 is positioned interiorly of and spaced from tubular member 52. Tubular member 52 is mounted on suitable bearing and coupled to motor 64 for rotation thereby. Toner particles are attracted from the carrier granules on the magnetic roll to the donor roll. Scraper blade 58 removes the nuded carrier granules and extraneous developer material from the surface of tubular member 52. Metering blade 62 adjusts the quantity of developer material being advanced to the loading zone adjacent the donor roll.

As successive electrostatic latent images are developed, the toner particles within the developer material are depleted. Auger 54 is mounted rotatably to mix fresh toner particles with the remaining developer material so that the resultant developer material therein is substantially uniform with the concentration of toner particles being optimized.

In order to prevent carrier granules form being transported from magnetic roll 44 to donor roll 40, a sealing member, indicated generally by the reference numeral 100 is interposed between donor roll 40 and magnetic roll 44. Sealing member 100 includes a pair of cantilevered sheets 102 and 104. Sheets 102 and 104 are made from sheet metal and extend the length of donor roll 40 and magnetic roll 44. One end of sheet 102 is secured to an extension 106 of housing 66. The other end of sheet 102 is free and positioned closely adjacent to donor roll 40. The free end of sheet 102 is located in the entrance 108 of the loading zone in the direction of rotation of sleeve 52 as indicated by arrow 98. Sheet 104 has one end thereof secured to an extension 110 of housing 66. The free end 112 of sheet 104 is located in the exit region of the loading zone. Both sheets 102 and 104 are made from a magnetizable material such as stainless steel and are about 0.002" thick. Elongated magnets 68 magnetizes sheets 102 and 104. Sheets 102 and 104 attract the magnetic carrier beads to the free ends thereof so as to seal donor roll 40 from magnetic roll 44. This prevents carrier granules from being transported from magnetic roll 44 to donor roll 40. The magnetized sheets 102 and 104 attract the magnetic carrier thereto forming a seal in contact with donor roll 40 without disturbing the toner layer.

Figure 2:
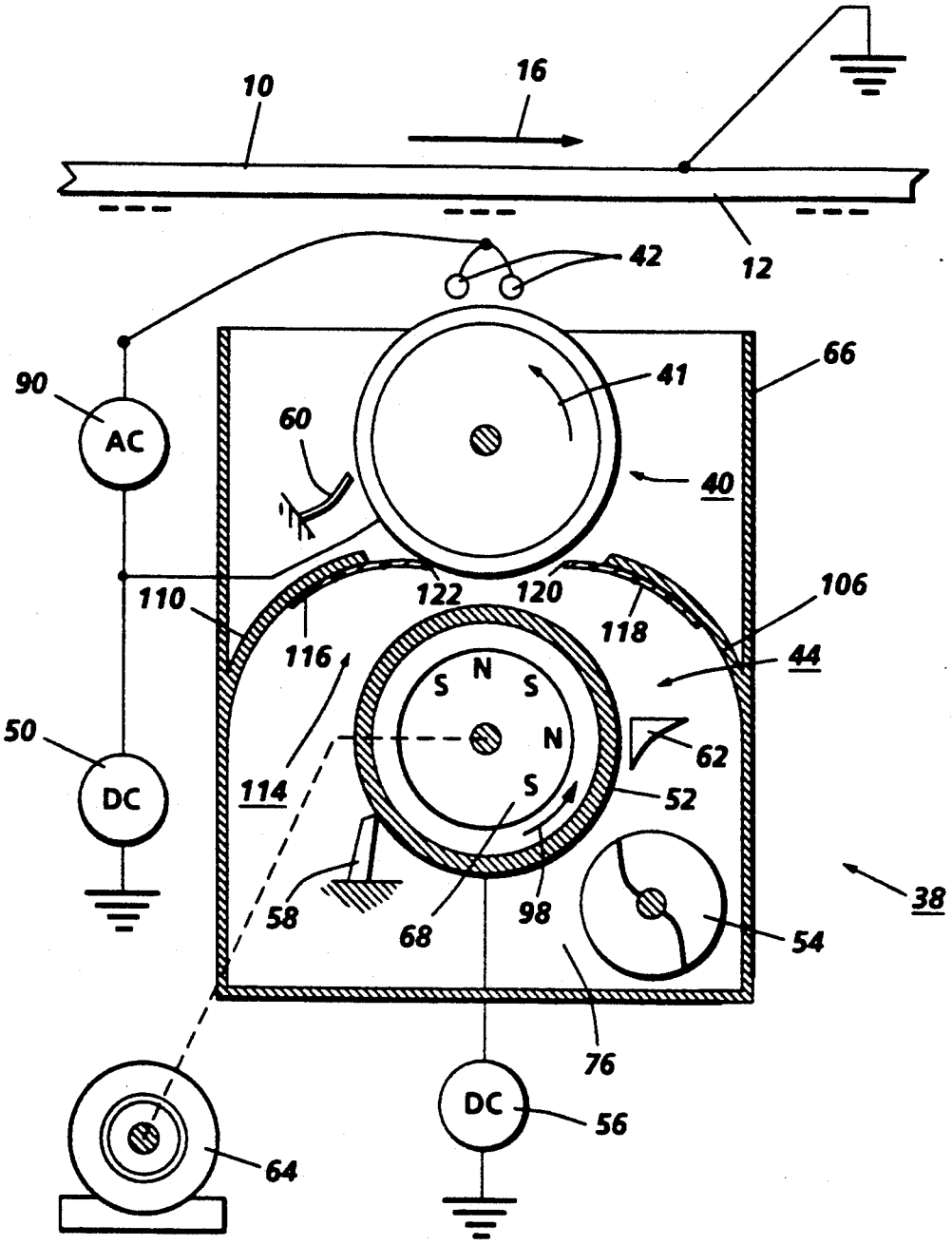
FIG. 2 is a schematic elevational view showing another embodiment of the development apparatus used in the FIG. 3 printing machine.

Turning now to FIG. 2, all of the elements of the developer unit depicted therein are substantially identical to those shown in FIG. 1 with the exception of the sealing member. FIG. 2 depicts another embodiment of the sealing member. Aside from the sealing member, no further description of the developer unit will be made as all of the references numerals utilized in FIG. 2 are identical to those described with reference to FIG. 1. Referring now to the sealing member, indicated generally by the reference numeral 114, this sealing member includes a sheet of magnetizable material 116 and a sheet of non-magnetizable material 118. The free end 120 of magnetizable sheet 118 is spaced from donor roll 40 and located in the entrance to the loading zone. Sheet 118 is mounted cantilevered fashion housing extension 106. Free end 122 of non-magnetizable sheet 116 is secured to housing extension 110. Sheet 116 is preferably made sheet 116 is secured to housing extension 110. Sheet 116 is preferably made from a plastic material having a thickness of about 0.003". Sheet 118 is preferably made from stainless steel having a thickness of about 0.002". In the embodiment depicted in FIG. 2, the sealing member includes a pair of sheet members. One of the sheet members is made from a non-magnetizable material with the free end thereof contacting the donor roll while the other sheet member is made from a magnetizable material with the free end thereof spaced from donor roll 40. The magnetized sheet 118 attracts the magnetic carrier thereto forming a seal in contact with donor roll 40 without disturbing the toner layer.

In recapitulation, it is evident that the development system of the present invention includes a sealing member having a pair of sheets. In one embodiment, both of the sheets are made from a magnetizable material with the free ends thereof closely spaced from the donor roll.

The free end of one of the sheets is located in the entrance to the loading zone with the free end of the other sheet being located in the exit from the loading zone. The loading zone is the gap between the magnetic roller and the donor roller. In another embodiment, one of the sheets is made from a non-magnetizable material with the free end thereof in contact with the donor roll while the other sheet is made from a magnetizable material with the free end thereof spaced from the donor roll. In this latter embodiment, the magnetizable sheet has its free end located in the entrance to the loading zone with the free end of the non-magnetizable sheet being located in the exit of the loading zone. In this way, the magnetizable sheets are magnetized by the magnet of the magnetic roller. The magnetized sheets then attract carrier beads thereto preventing the carrier beads from being transported from the magnetic roller to the donor roller.

It is, therefore, apparent that there has been provided in accordance with the present invention, a sealing arrangement for a development system that fully satisfies the aims and advantages set forth. While this invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface with toner, including:

a magnetic member adapted to transport magnetic carrier and toner to a loading zone;

a donor member, positioned adjacent the magnetic member, to receive toner therefrom at the loading zone, said donor member being spaced from the surface for advancing toner to a developing zone adjacent the surface; and a sealing member, interposed partially between said magnetic member and said donor member, to prevent carrier from being transported from said magnetic member to said donor member, said sealing member comprising a first sheet of magnitizable material having a free end thereof in a closely spaced relationship with said donor member on one side of the loading zone, and a second sheet having a free end thereof in a closely spaced relationship with said donor roll on the other side of the loading zone.

2. An apparatus according to claim 1, wherein said magnetic member induces a magnetic field in said first sheet of sealing member so that said sealing member attracts magnetic carrier thereto forming a seal of magnetic carrier in contact with said donor member without disturbing the toner on said donor member.

3. An apparatus according to claim 2, wherein:

said magnetic member includes a rotatably mounted magnetic roll; and said donor member includes a rotatably mounted donor roll.

4. An apparatus according claim 3, further including:

an electrode member positioned in the development zone between the surface and said donor member;

means for electrically biasing said electrode member to detach toner from said donor roll to form a cloud of toner in the space between said electrode member and the surface with toner developing the latent image.

5. An apparatus according to claim 4, wherein said electrode member includes a plurality of wires.

6. An apparatus for developing a latent image recorded on a surface with toner, including:

a rotatably mounted magnetic roll adapted to transport magnetic carrier and toner to a loading zone;

a rotatably mounted donor roll, positioned adjacent said magnetic roll, to receive toner therefrom at the loading zone, said donor roll being spaced from the surface for advancing toner to a development zone adjacent the surface; and a sealing member, interposed partially between said magnetic roll and said donor roll, to prevent carrier from being transported from said magnetic roll to said donor roll, said sealing member comprising a first sheet of magnetizable material having a free end thereof in a closely spaced relationship with said donor roll on one side of the loading zone, and a second sheet of magnetizable material having a free end thereof in a closely spaced relationship with said donor roll on the other side of the loading zone.

7. An apparatus for developing a latent image recorded on a surface with toner, including:

a rotatably mounted magnetic roll adapted to transport magnetic carrier and toner to a loading zone;

a rotatably mounted donor roll, positioned adjacent said magnetic roll, to receive toner therefrom at the loading zone, said donor roll being spaced from the surface for advancing toner to a development zone adjacent the surface; and a sealing member, interposed partially between said magnetic roll and said donor roll, to prevent carrier from being transported from said magnetic roll to said donor roll, said sealing member comprising a sheet of magnetizable material having a free end thereof in a closely spaced relationship with said donor roll on one side of the loading zone, and a sheet of non-magnetizable material having a free end thereof contacting said donor roll on the other side of the loading zone.

8. An apparatus according to claim 7, wherein said sheet of magnetizable material is positioned at the entrance side of the loading zone with said sheet of non-magnetizable material being positioned at the exit side of the loading zone in the direction of rotation of said magnetic roll.

9. An electrophotographic printing machine of the type in which a photoconductive member is developed with toner to form a visible image thereof, wherein the improvement includes:

a magnetic member adapted to transport magnetic carrier and toner to a loading zone;

a donor member, positioned adjacent said magnetic member, to receive toner therefrom at the loading zone, said donor member being spaced from the photoconductive member for advancing toner to a development zone adjacent the photoconductive member; and a sealing member, interposed partially between said magnetic member and said donor member, to prevent carrier from being transported from said magnetic member to said donor member, said sealing member comprising a first sheet of magnetizable material having a free end thereof in a closely spaced relationship with said donor member on one side of the loading zone, and a second sheet having a free end thereof in a closely space relationship with said donor member on the other side of the loading zone thereof.

10. A printing machine according to claim 9, wherein said magnetic member induces a magnetic field in said first sheet of sealing member so that said sealing member attracts magnetic carrier thereto forming a seal of magnetic carrier in contact with said donor member without disturbing the toner on said donor member.

11. A printing machine according to claim 10, wherein:

said magnetic member includes a rotatably mounted magnetic roll; and said donor member includes a rotatably mounted donor roll.

12. A printing machine according to claim 11, further including:

an electrode member positioned in the development zone between the photoconductive member and said donor member; and means for electrically biasing said electrode member to detach toner from said donor roll to form a cloud of toner in the space between said electrode member and the photoconductive member with toner developing the latent image.

13. A printing machine according to claim 12, wherein said electrode member includes a plurality of wires.

14. An electrophotographic printing machine of the type in which a photoconductive member is developed with toner to form a visible image thereof, wherein the improvement includes:

a rotatably mounted magnetic roll adapted to transport magnetic carrier and toner to a loading zone;

a rotatably mounted donor roll, positioned adjacent said magnetic roll, to receive toner therefrom at the loading zone, said donor roll being spaced from the photoconductive member for advancing toner to a development zone adjacent the photoconductive member; and a sealing member, interposed partially between said magnetic roll and said donor roll, to prevent carrier from being transported from said magnetic roll to said donor roll, said sealing member comprising a first sheet of magnetizable material having a free end thereof in a closely spaced relationship with said donor roll on one side of the loading zone, and a second sheet of magnetizable material having a free end thereof in a closely spaced relationship with said donor roll on the other side of the loading zone.

15. An electrophotographic printing machine of the type in which a photoconductive member is developed with toner to form a visible image thereof, wherein the improvement includes:

a rotatably mounted magnetic roll adapted to transport magnetic carrier and toner to a loading zone;

a rotatably mounted donor roll, positioned adjacent said magnetic roll, to receive toner therefrom at the loading zone, said donor roll being spaced from the photoconductive member for advancing toner to a development zone adjacent the photoconductive member; and a sealing member, interposed partially between said magnetic roll and said donor roll, to prevent carrier from being transported from said magnetic roll to said donor roll, said sealing member comprising a sheet of magnetizable material having a free end thereof in a closely spaced relationship with said donor roll on one side of the loading zone, and a sheet of non-magnetizable material having a free end thereof contacting said donor roll on the other side of the loading zone.

16. A printing machine according to claim 15, wherein said sheet of magnetizable material is positioned at the entrance side of the loading zone with said sheet of non-magnetizable material being positioned at the exit side of the loading zone in the direction of rotation of said magnetic roll.

* * * * *